United States Patent [19]

Wada et al.

[11] 3,932,236

[45] Jan. 13, 1976

[54] METHOD FOR PRODUCING A SUPER LOW WATT LOSS GRAIN ORIENTED ELECTRICAL STEEL SHEET

[75] Inventors: Toshiya Wada, Kitakyushu; Tadao Nozawa, Munakata; Toshihiko Takata, Kitakyushu, all of Japan

[73] Assignee: Nippon Steel Corporation, Japan

[22] Filed: Jan. 18, 1974

[21] Appl. No.: 434,449

[30] Foreign Application Priority Data

Jan. 22, 1973 Japan ..... 48-8704

[52] U.S. Cl. ..... 148/113; 148/31.55; 148/31.5

[51] Int. Cl.[2] ..... H01F 1/04

[58] Field of Search ..... 148/113, 111, 110, 31.55, 148/6.35, 6.31, 177, 122, 31.5; 29/196.3

[56] References Cited

UNITED STATES PATENTS

| | | | |
|---|---|---|---|
| 2,385,332 | 9/1945 | Carpenter et al. | 148/113 |
| 2,394,047 | 2/1946 | Elsey et al. | 148/113 |
| 2,528,216 | 10/1950 | Dunn et al. | 148/113 |
| 3,223,602 | 12/1965 | Wawrousek | 148/111 |
| 3,347,718 | 10/1967 | Carpenter et al. | 148/111 |
| 3,575,739 | 4/1971 | Fiedler | 148/111 |
| 3,764,406 | 10/1973 | Littmann | 148/111 |
| 3,833,431 | 9/1974 | Foster et al. | 148/113 |
| 3,834,952 | 9/1974 | Matsushita et al. | 148/112 |

*Primary Examiner*—Walter R. Satterfield

*Attorney, Agent, or Firm*—Toren, McGeady and Stanger

[57] ABSTRACT

A method for producing a grain-oriented electrical steel sheet showing super low watt loss, comprising making a silicon steel ingot containing 2.5 to 4.0% of Si, subjecting the ingot treatments including hot rolling, annealing and at least one cold rolling to obtain a final size, subjecting the steel to decarburization annealing and a finishing annealing which completes secondary recrystallization, subjecting the steel to remove surface product and then subjecting the steel to chemical polishing or electrolytic polishing to polish the steel surface to mirror condition.

2 Claims, 1 Drawing Figure

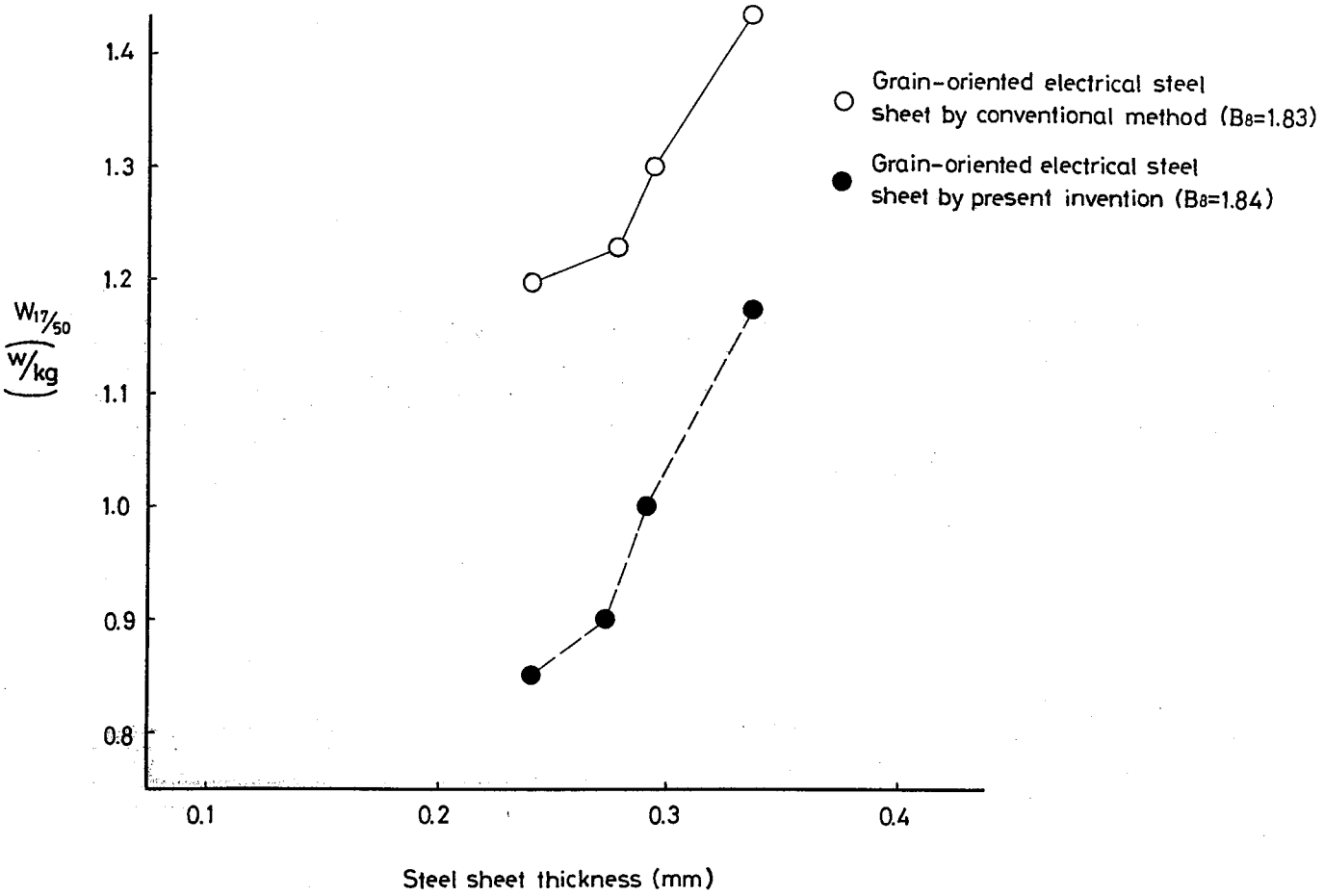
Grain-oriented electrical steel sheet by conventional method (B8=1.83)
Grain-oriented electrical steel sheet by present invention (B8=1.84)
1.4
1.3
1.2
1.1
1.0
0.9
0.8
W17/50 (W/kg)
0.1
0.2
0.3
0.4
Steel sheet thickness (mm)

METHOD FOR PRODUCING A SUPER LOW WATT LOSS GRAIN ORIENTED ELECTRICAL STEEL SHEET

The present invention relates to a method for producing a grain-oriented electrical steel sheet having a remarkably low watt loss as compared with conventional ones.

The properties of a grain-oriented electrical steel sheet are specified particularly by so-called magnetic flux density and watt loss characteristics, and lower watt loss values represent a better product. As a standard for the watt loss of a grain-oriented electrical steel sheet, Japanese Industrial Standards (JIS) specify a magnetic flux density of 17,000 gauss and not more than 1.33 w/Kg in 50 Hz for the lowest watt class in case of 0.3 mm thick sheets.

The grade M3 specified by AISI in U.S.A. shows about 0.74 w/lbs in 60 Hz at 17,000 gauss, which correspond to 1.24 w/Kg in 50 Hz at 17,000 gauss. The M3 sheets are produced in 9 mil thickness as the highest grade in U.S.A.

Nippon Steel Corporation in Japan produces and sells a grain oriented electrical steel sheet having a high magnetic flux density under a trademark of "Orient Core Hi-B".

This product shows a higher magnetic flux density and a lower watt loss value at high magnetic flux densities as compared to conventional grain oriented electrical steel sheets. The sales standard (M2H) for this 0.3 mm thick product specifies 1.17 w/Kg (W 17/50) which represents a grade showing the lowest watt loss, better than the M3 grade of 9 mil thickness.

The present invention relates to a method for producing a novel grain-oriented electrical steel sheet having super low watt loss as 17,000 gauss and 0.70 to 0.80 w/Kg in 50 Hz which is lower by several grades than that of conventional grain-oriented electrical steel sheets and can not be expected from the technical unknown heretofore.

Known factors which affect the watt loss of grain-oriented electrical steel sheets are sheet thickness, specific resistance, impurities, grain orientation and grain size. In addition, the sheet surface glass, the roughness of the roll surface during rolling operations and the surface roughness of the sheet are known to affect the watt loss. It is widely known the sheet thickness affects the watt loss, and conventionally 14 mil and 12 mil thick products were mainly produced, but in recent years, 12 mil and 11 mil products are mainly produced and partially, 9 mil products are produced. These products are difficult to produce, but steel makers have been forced to produce these thin sheets because a desirably low watt loss can not be obtained even by improvements of specific resistance, impurities, grain-orientation, surface roughness, etc.

However, even if the sheet thickness is decreased the improvement of watt loss is limited.

It is mainly due to a decrease of eddy current loss that watt loss lowers as the sheet thickness decreases. Supposing all other factors being equal hysteresis loss increases in inverse proportion to the sheet thickness decrease, and particularly, in the case of sheets of less than 11 mil thickness, it increases suddenly and offsets the decrease of eddy current loss and thus no substantial improvement can not be obtained in respect of the total watt loss. On the contrary, in case of thin sheets beyond a 9 mil thickness, the total watt loss often increases as the sheet thickness decreases. Recently it has been reported that remarkably low watt loss values are obtained for high magnetic flux density grain-oriented electrical steel sheets. For example 17 KG, 1.02 w/Kg in 50 Hz for 9 mil thick products are known.

The present invention can improve this watt loss characteristics further by more than 20% and yet can obtain this improvement even in case of thicker sheets.

Conventional grain-oriented electrical steel sheets have been produced mainly by the so-called Goss method, namely a twice cold rolling method. Partially some sheets are produced by a single cold rolling method. Summary of the twice cold rolling method follows.

A coil of hot rolled silicon steel containing 2.5 to 4% of silicon and, if necessary, one or more of Mn, S, Al, Se, V and Ti is descaled, cold rolled with about 70% reduction to obtain a thickness about two times of the thickness of the final product. This cold rolled sheet is subjected to recrystallization by intermediate annealing and again cold rolled into the final thickness.

Then the sheet is subjected to decarburization annealing to lower the carbon content to 0.003% or less, coated with an annealing separating agent, such as, one composed mainly of MgO and finally subjected to finishing annealing. This finishing annealing is conducted at a high temperature, for example, at 1,200°C, so that secondary recrystallization is caused and the so-called Goss structure is obtained and at the same time, N and S in the steel are removed and the watt loss is reduced. Also by this high temperature finishing annealing, silicates, such as, $SiO_2$ and $Fe_2SiO_4$ produced on the steel surface during the decarburization annealing react with the annealing separating agent, such as, MgO etc. to form a glass-like film. Then, after the finishing annealing, excessive MgO which does not take part in the formation of the glass-like film is removed by water washing to obtain a final product having a glass-like film surface. In some cases, this final product is baked with phosphate on its glass-like surface and further subjected to heat treatment for flattening. In still some other cases, the glass-like film is removed by acid pickling and the sheet is baked with phosphate to obtain a final product.

The present invention aims to improve remarkably the watt loss characteristics by giving a special treatment to the sheet surface at the end portion of the above production process.

The present invention is based on the following four basic discoveries.

1. The oxide layer on or near the surface of the steel sheet is very harmful to the watt loss characteristics. Therefore, the watt loss characteristics is remarkably improved when formation of the oxide layer is prevented or, if formed, when it is removed.

In this case, it is necessary to remove an oxide layer which exists as subscale. Thus, one of the important discoveries on which the present invention is based is that the portions near the steel surface have a very poor magnetic property due to the oxide layer, particularly the subscale.

The phenomenon that improvement of the watt loss characteristics is not in proportion to the sheet thickness decrease, but the watt loss characteristics worsens for sheets of less than 9 mil thickness can be attributed to the fact that the ratio of the thickness of the oxide layer to the total sheet thickness increases. It has been discovered that if this oxide layer is not present, the watt loss decreases as the sheet thickness decreases. Such oxide layer is formed always when a silicon steel is subjected to annealing, particularly high temperature annealing unless the annealing is done in a special atmosphere, such as, a vacuum annealing, and decarburization annealing and treatments which produce a glass-like film are particularly harmful. The decarburization annealing is particularly harmful when it is conducted after the sheet is reduced to its final thickness. The harmful effect can be alleviated when the decarburization annealing is conducted to sheets of intermediate gauge or sheets of hot rolled thickness. Also a high temperature finishing annealing which produces a glass-like film is an oxidation reaction by itself and is undesirable. Therefore, in the treatment where the steel sheet is annealed with MgO being coated on to its surface, it is important to avoid formation of the glass-like film and the subscale. For this purpose, it is necessary to reduce $O_2$ and $H_2O$ contents in the finishing annealing atmosphere to an extremely small amount as well as to make the MgO inactive. Even with these measures, the oxide layer formation though it is in a small amount, can not be avoided. The present inventors have discovered that the magnetic property, particularly the watt loss can be improved by acid pickling the surface of products in which the thickness of such oxide layer is reduced.

2. The second discovery on which the present invention is based is that the surface condition after the acid pickling of secondarily recrystallized products as mentioned before has an important effect on the magnetic property. Namely, when the steel sheet surface is subjected to chemical polishing or electrolytic polishing to obtain mirror brightness, the watt loss of the steel sheet lowers suddenly. The polishing should be done to a degree enough to remove all concaves and convexes including the subscale, and if such enough polishing is not made, any improvement of the watt loss can not be obtained though some improvement of permeability can be obtained. The improvement of the watt loss obtained by the present invention is extraordinarily large and differs by even 30 to 40% between before and after the polishing. Such remarkable improvement of the watt loss is possibly due to the basic change of the magnetization mechanism. These surface polishings are not effective unless they are given to products which have completed secondary recrystallization, and the thus obtained delicate surface is completely lost by annealing. Further, the improved characteristics is lost also by the coating of active chemicals, such as, phosphate on the surface.

The phenomenon that the magnetic property is improved if the surface is smoothed has already been reported. For example, V. W. Carpenter et al. disclosed as a method for improving ferrous magnetic materials and their properties (Japanese Patent Publication Sho 43-5990) that the magnetic property is improved when the rolling before the final annealing is done using smooth rolls of $12.7 \times 10^{-6}$cm (5 microinches). In this disclosure, they reported comparisons between the dull rolling and the smooth rolling and reported that watt loss 0.766 w/lbs of W 17/50 in 11 mil was improved to 0.695 w/lbs ($\approx$1.20 w/Kg). However, the above level of watt loss in 11 mil is not particularly good. Nippon Steel Corporation produces M2H high magnetic flux density grain oriented electrical steel sheet as its main products for the 12 mil grade, and its watt loss is specified as 1.17 w/Kg.

The distinction will be clearly understood in view of the fact that 0.80 w/Kg (W 17/50) in 12 mil is possible according to the present invention. Further the improvements obtained by the present invention can not be attained by smoothing the rolling roll as smooth as possible, but they relate to the presence of super micro convexes and concaves such as caused by oxidation by annealing in dry hydrogen.

3. Further according to the discovery by the present inventors, the watt loss is remarkably improved when tension is given to the steel sheet treated by above (1) and (2). Regarding the magnetic property of a grain-oriented electrical steel sheet, it was known that magnetostriction etc. are improved by tension within the elasticity range. Thereafter, in case of the above high magnetic flux density grain-oriented electrical steel sheet, it has been found that the watt loss is improved by tension. At first it was considered this phenomenon is a unique phenomenon which takes place only in case of a material as a high magnetic flux density grain-oriented electrical steel sheet having good orientation. However, it has been found that the watt loss is lowered by tension irrespective of the material in case of the steel sheet treated by the present invention. This tension, in fact, is given by the glass-like film or coatings. Therefore, the magnetic property is improved by a coating having large tension.

4. According to a still other discovery by the present inventors, the magnetic property is further improved by plating the steel sheet treated by the above (1) and (2).

The main roles of the plating are following two roles. One is that the magnetic property is improved by the plating itself, although the reasons therefor are not known. It is probable that the plating gives some tension. The second effect of the plating is that as given by a substrate under the coating. The steel sheet which shows remarkably low watt loss by the chemical polishing or electrolytic polishing described in (2) has a very delicate and unstable nature, and when the sheet is left as it stands for several days, micro rust is caused and the watt loss deteriorates to the level of the ordinary steel sheet. However, when coatings of phosphates, etc. instead of the above plating are given in order to prevent the rust formation, the delicate equilibrium state is destroyed so that the sheet becomes similar to an ordinary steel sheet. Namely, coating can not be given directly after the polishing. Once metallic plating is made, the coating can be done without such deterioration.

The present invention is based on the above basic discoveries. However, it is not necessary to combine all of the above discoveries, and for example, it is possible to effect a rust prevention treatment, such as varnishing for preventing the rust formation without the coatings or platings.

In this case, however, the improvement by tension is not obtained.

The production process of a grain-oriented electrical steel sheet showing super low watt loss according to the present invention will be described in detail hereinunder.

The silicon steel material to be treated by the present invention is melted and refined in a melting furnace, such as, a converter, an open hearth and an electric furnace, adjusted in its composition, and composed of 2.5 to 4% of silicon as the main alloying element together with some additions of Mn, S, Al, etc. with the balance being unavoidable impurities and Fe.

If the silicon content in the steel material to be treated by the present invention is less than 2.5%, a satisfactory magnetic property can not be obtained, and on the other hand, if it exceeds 4.0%, problems in workability are caused. Thus the silicon content is limited to the above range. The molten steel of the above composition is cast by a continuous casting, or by an ordinary casting and breaking-down into slabs.

The slab is hot rolled under conventional conditions into a hot coil of 2.0 to 3.0 mm thickness. Then the hot coil is subjected to acid pickling with or without annealing. In case of a single cold rolling method, the coil is rolled directly to a final thickness.

Then the coil is subjected to decarburization annealing, applied with an annealing separating agent and further subjected to finishing annealing.

As for the separating agent, usually MgO is used, and oxides such as $Cr_2O_3$, $TiO_2$, $MnO_2$ are sometimes added thereto in order to promote the formation of a glass-like film. However, it is advantageous to avoid the formation of a glass-like film in the present invention although it does not matter whether the formation is caused or not caused. In any way, as the glass-like film must be removed at the stage of a final product, it is advantageous to use inactive MgO obtained by a high temperature calcining so as to avoil the formation of a glass-like film, or to add further $SiO_2$, $Al_2O_3$, etc. which prevent the film formation.

The finishing annealing for the secondary recrystallization is conducted under conventional conditions, for example, at a temperature near 1,200°C for 20 hours. The atmosphere may be of dry hydrogen, dry decomposed ammonia, etc., and also a vacuum atmosphere may be used. In case of production of an ordinary grain-oriented electrical steel sheet, the annealing separating agent is washed off by a scrubber after the finishing annealing to obtain a final product, or an insulating film is applied on the glass-like film and a heat treatment is done to eliminate coil set, or further the glass-like film is removed by acid pickling and an insulating film is baked and at the same time a heat treatment for flattering is done.

The main feature of the present invention lies in that the silicon steel sheet after the finishing annealing is given a mirror finish to its surface by polishing and is subjected to a treatment to obtain a mirror brightness without concaves and convexes.

Thus in the present invention, the silicon steel sheet after the finishing annealing is treated with a strong acid, such as, sulfuric acid, nitric acid and fluoric acid to remove the surfacial glass-like film as well as the subscale therebeneath.

After the acid pickling, the surface of the silicon steel sheet is given a mirror finish by polishing such as a chemical polishing or electrolytic polishing, etc. which the most important feature of the present invention.

The above polishing for a mirror finish in the present invention has no special limitation in its conditions and means, but the polished surface of the steel sheet should be finished to a mirror state. Otherwise the object of the present invention can not be obtained.

According to the discoveries by the present inventors, the best results can be obtained most consistently with electrolytic polishing.

As mentioned above, a remarkable watt loss improvement can be obtained when the silicon steel sheet, after the finishing annealing, is subjected to mirror finishing by polishing, but the steel sheet as mirror finished as specified in the present invention has very delicate and unstable nature, and when it is left as treated for several days, microscopic rust which can not be observed by naked eyes is caused and the once improved watt loss is deteriorated. However, when a chemical conversion treatment, such as, a phosphate treatment, etc. as a surface treatment for preventing the rust formation is given directly, the watt loss characteristics is deteriorated and thus the effects of the present inventive treatment can not be obtained.

In case when the silicon steel sheet treated by the present invention is not used immediately and is stored for a certain period, it is recommended to apply varnishing.

The present inventors have conducted various extensive studies on improvement of the watt loss, it has been found, as mentioned before, that the watt loss is further improved by applying a metallic plating on the silicon steel sheet treated by the present invention.

The metallic plating applied according to the present invention is not limited in its plating metal and method, but it is most practical to apply metallic platings such as of Zn, Sn, Cu and Ni.

Regarding the thickness of the plating, a thinner plating is more suitable, and desirable results can be obtained when the thickness is not more than 5$\mu$. Generally, when the plating thickness increases, a dilution action appears to lower the magnetic characteristics due to the relatively increased thickness of the plating to the substrate thickness.

Although the plating method is not limited particularly, a chemical plating or electrolytic plating is suitable for obtaining a thin plating. The metallic plating contributes to improve the watt loss of the silicon steel sheet and gives a known insulating film of phosphate, etc. on the plating layer.

Also when the silicon steel sheet applied with an underlying treatment such as a metallic plating is given an insulating film of phosphate, no deterioration of the watt loss is observed as in case of the direct formation of the insulating film, and rather further improved watt loss can be obtained. Thus, the silicon steel sheet which has been polished to a mirror state and further applied with the metallic plating according to the present invention is then coated and baked with a glass-like film agent of such composition as gives tension to the steel sheet, or an insulating film agent, for example, a phosphate film. In this case, the conditions for the coating and baking are not particularly limited and conventional insulating film forming means may be used.

The silicon steel sheet applied with a metallic plating and coating as above can be subjected to a heat treatment for removing the coiling bent without deterioration of the magnetic property, and thus a flattening heat treatment can be applied.

The present invention will be described in detail referring to the following examples.

EXAMPLE 1

Molten steel prepared in a converter and containing 3.15% of Si, 0.08% of Mn, 0.013% of P, 0.025% of S and 0.025% of C was cast into ingots and broken down into slabs. The slab was continuously hot rolled into a coil of 2.3 mm thickness, annealed at 900°C for 1 minute and subjected to acid pickling. Then the coil was cold rolled to 0.60 mm thickness and then subjected to intermediate annealing at 900°C for 30 seconds.

After cold rolling to 0.3 mm thickness, the coil was subjected to decarburization annealing at 850°C for 2 minutes. Then, a mixture of non-hydrating MgO and finely divided silicate in a ratio of 8 : 2 was applied as an annealing separating agent. The finishing annealing was done at 1,200°C for 20 hours in a hydrogen atmosphere. Then, after the acid pickling in a mixed acid of $H_2SO_4$ and $HNO_3$, a chemical polishing was done for 10 seconds in a solution of $H_3PO_4$ and $H_2O_2$ to give a mirror brightness to the surface. Thereafter, copper plating was done by immersing the coil for about 5 seconds in 2% copper sulfate solution and an insulating film mainly composed of phosphate was applied.

The magnetic characteristics before and after the surface treatment are shown in Table 1.

Table 1

| | Magnetic Characteristics Before and After Surface Treatment B8 | W 17/50 | Total Thickness |
|---|---|---|---|
| After Finishing | 1.83 wb/m | 1.28 w/Kg | 0.300 mm |
| After Chemical Polishing | 1.83 | 0.95 | 0.290 |
| After Copper Plating | 1.83 | 0.90 | 0.292 |
| After Coating | 1.82 | 0.88 | 0.295 |

The watt loss value of W 17/50 = 1.28 w/Kg after the finishing annealing is a normal value for 0.30 mm thick grain-oriented electrical steel sheets. After the chemical polishing, thus value lowers to 0.95 w/Kg and after the copper plating and the coating suprisingly lowers to 0.88 w/Kg. When the specimen after the polishing was left 10 days and measured, the watt loss deteriorated to W 17/50 = 1.31 w/Kg. However, in case of the specimens applied with the copper plating the coating, no such deterioration was observed. It was revealed by a microscopic observation that rust was formed slightly, although unobservable by naked eyes, on the specimens after the polishing. It is understood from the results that the magnetic property is remarkably improved and the improvement depends on the very delicate surface condition.

FIG. 1 shows the relation between the sheet thickness and the watt loss for the silicon steel sheet obtained by this example and a conventional silicon steel sheet. It is also clear from the FIGURE that far better results can be obtained by the present invention.

EXAMPLE 2

Molten steel prepared in a converter and containing 2.95% of Si, 0.09% of Mn, 0.015% of P, 0.025% of S, 0.043% of C and 0.028% of Al was cast into slabs by continuous casting. The slab was continuously hot rolled to a coil 2.5 mm thickness, and the coil was annealed, subjected to acid pickling and then cold rolled to 0.28 mm thickness.

The coil was subjected to decarburization annealing to lower the carbon content to 0.002% and then applied with an annealing separating agent of a mixture of MgO and $Al_2O_3$ in a ratio of 3 : 1. Then coil was annealed at 1,200°C for 20 hours in a hydrogen atmosphere. After the finishing annealing, the coil was subjected to acid pickling in a solution of $HNO_3$ and $H_2SO_4$ (1 : 1) with addition of 1% glycerin, and successively to electrolytic polishing in a solution of $CrO_3$ and $H_3PO_4$ (1 : 2). After the electrolytic polishing, copper plating was done in a copper sulfate solution, and further an insulating film of phosphate was coated thereon and baked.

The magnetic characteristics before and after the surface treatment are shown in Table 2.

Table 2

| | B8 | W 17/50 | Thickness |
|---|---|---|---|
| After Finishing Annealing | 1.93 wb/m | 1.04 w/Kg | 0.285 mm |
| After Electrolytic Polishing | 1.93 | 0.84 | 0.270 |
| After Copper Plating | 1.93 | 0.80 | 0.270 |
| After Coating | 1.92 | 0.75 | 0.275 |

It is clear from the above results that the magnetic characteristics after the electrolytic polishing are remarkably improved.

Also the watt loss is improved by the copper plating and the coating, and watt loss values unexpectable by any known method can be attained by the present invention.

In case of the specimen which was left after the electrolytic treatment, the watt loss deteriorated to W 17/50 = 1.28 w/Kg after one week. Whereas no change was observed for the specimens after the copper plating alone or after the copper plating and the coating.

In this way, the watt loss can be remarkably improved by controlling the factors which have never been considered.

As for the method for the chemical polishing and the electrolytic polishing, there are various conditions such as combination of chemicals current density and voltage, etc. but these conditions can be selected from the points of economy and operation. Also there is no specific limitation for the kind of metal platings and plating methods.

The watt loss can be improved by any method so far as it does not deviate from the scope of the present invention.

What is claimed is:

1. In a method for producing a grain-oriented electrical steel sheet having super low watt loss wherein a silicon steel sheet ingot or slab containing 2.5 to 4.0% Si is subjected to hot rolling, annealing and at least one cold rolling to a final thickness, and the steel is subjected to decarburization annealing and a finishing annealing to complete the secondary recrystallization, and the surface of the steel is then cleaned, the improvement which comprises after said surface cleaning step, polishing the surface of the steel to a mirror finish by electrolytic or chemical polishing and applying a thin metal plating to the polished surface.

2. The method of claim 1 wherein an insulating film is applied and baked onto the plated surface.

* * * * *